US007109453B1

(12) United States Patent
Nadolski

(10) Patent No.: US 7,109,453 B1
(45) Date of Patent: Sep. 19, 2006

(54) MICROWAVE HOT WATER SYSTEM

(76) Inventor: Keith A Nadolski, 123 Strobel Rd., Trumbell, CT (US) 06611

( * ) Notice: Subject to any disclaimer, the term of this patent is extended or adjusted under 35 U.S.C. 154(b) by 0 days.

(21) Appl. No.: 11/048,249

(22) Filed: Feb. 1, 2005

(51) Int. Cl.
*H05B 6/80* (2006.01)

(52) U.S. Cl. ..... 219/688; 219/687; 219/759

(58) Field of Classification Search ..... 219/688, 219/687, 759, 756, 761, 682, 702, 748, 749, 219/750, 751; 392/314, 322, 324, 339, 341, 392/342

See application file for complete search history.

(56) References Cited

U.S. PATENT DOCUMENTS

| | | | | |
|---|---|---|---|---|
| 2,978,562 | A | 4/1961 | Fox | |
| 3,778,578 | A | 12/1973 | Long et al. | |
| 3,816,689 | A | 6/1974 | Long | |
| 3,891,817 | A | 6/1975 | Brown | |
| 3,920,945 | A | 11/1975 | Smith et al. | |
| 4,114,011 | A | 9/1978 | Stubbs | |
| 4,358,652 | A | 11/1982 | Kaarup | |
| 6,064,047 | A | 5/2000 | Izzo | |
| 6,858,824 | B1 * | 2/2005 | Monteleone et al. | 219/688 |

FOREIGN PATENT DOCUMENTS

| | | |
|---|---|---|
| DE | 3.139.268 | 4/1983 |
| EP | 0351300 | 1/1990 |
| PT | 80319 A * | 10/1985 |
| WO | WO95/08908 | 3/1995 |
| WO | WO2004/054705 | 7/2004 |

* cited by examiner

*Primary Examiner*—Quang T. Van
(74) *Attorney, Agent, or Firm*—Michael I Kroll

(57) ABSTRACT

The present invention provides a microwave heating system. The system includes a holding tank for retaining water positioned around a central core. A rotating heating device is positioned around the holding tank. The holding tank includes a motor connected to the holding tank. An armature is connected to the motor. Pluralities of microwave emitters depend from and are supported by the armature. A bearing ring is connected to each of the plurality of emitters at an end opposite the armature. The bearing ring further supports the plurality of microwave emitters.

20 Claims, 12 Drawing Sheets

| | COL. 1 | COL. 2 | COL. 3 |
|---|---|---|---|
| | HEATING SYSTEM | ADVANTAGES | DISADVANTAGES |
| ROW 1 | MICROWAVE | FIRE DANGER SAFETY<br>EFFICIENCY<br>UNIFORMITY<br>PRECISION CONTROL | POWER REQUIREMENTS |
| ROW 2 | OIL | - | VOTILE COST<br>ANNUAL PROFESSIONAL SERVICE<br>PERIODIC FUEL REPLENISHMENT<br>POWER REQUIREMENTS |
| ROW 3 | KEROSENE | FIRE DANGER SAFETY<br>ANNUAL PROFESSIONAL SERVICE | FIRE DANGER SAFETY<br>ANNUAL PROFESSIONAL SERVICE<br>PERIODIC FUEL REPLENISHMENT<br>POWER REQUIREMENTS |
| ROW 4 | COAL | NO POWER REQUIREMENTS | FIRE DANGER SAFETY<br>UNPERPORTIONED HEATING<br>DIRTY SILT BYPRODUCT |
| ROW 5 | WOOD | NO POWER REQUIREMENTS | FIRE DANGER SAFETY<br>UNPERPORTIONED HEATING<br>DIRTY SILT BYPRODUCT |
| ROW 6 | NATURAL GAS | ECONOMIC<br>CLEAN<br>NO REPLENISHMENT NEEDS | FIRE DANGER SAFETY<br>ANNUAL PROFESSIONAL SERVICE<br>POWER REQUIREMENTS |

FIG. 12

MICROWAVE HOT WATER SYSTEM

BACKGROUND OF THE INVENTION

1. Field of the Invention

The present invention relates generally to heating systems and, more specifically, to microwave hydronic heating systems. The present invention provides a hydronic heating system with improved efficiency and selectability. The hydronic system pumps hot water from a boiler through pipes and radiators and returns it to be reheated and recirculated. The microwave heating system of the present invention consists of a holding tank surrounding the central core containing water that is held proximate to microwave emitters for heating the water. The microwave emitters irradiate the contained water and central core uniformly causing the water causes the water and the core's temperature to rise. The temperature of the water is maintained by the retention of heat energy within the central core gathered from the emitted microwaves.

2. Description of the Prior Art

There are other golf devices designed for training. Typical of these is U.S. Pat. No. 3,918,073 issued to Henderson, James F. on Nov. 4, 1975.

Another patent was issued to Hass, Steven L. on Jan. 30, 1979 as U.S. Pat. No. 4,137,566.

Yet another U.S. Pat. No. 4,254,956 was issued to Rusnak, Thomas L. on Mar. 10, 1981 and still yet another was issued on Oct. 26, 1993 to Marsh, James T. as U.S. Pat. No. 5,257,084.

Another patent was issued to Terry, J. Stanford III on Jun. 18, 1996 as U.S. Pat. No. 5,527,041. Yet another U.S. Pat. No. 6,071,202 was issued to Densberger, John A. on Jun. 6, 2000. Another was issued to Goszyk, Kurt A. on Aug. 1, 2000 as U.S. Pat. No. 6,095,928 and still yet another was issued on Jul. 20, 2004 to Gobush, William as U.S. Pat. No. 6,764,412.

Internationally, a patent was issued to Umlauf, Edgar on Oct. 24, 2002 as Patent No. DE10119740. Yet another World Patent No. WO02070082 was issued to O'Reilly, Michael on Sep. 12, 2002.

U.S. Pat. No. 2,978,562

Inventor: H. D. Fox.

Issued: Apr. 4, 1961

This invention relates to a new method and apparatus of producing hot water in any type of hot water heating system, and is particularly advantageous where the usage is intermittent. This system utilizes the energy released by a magnetron tube to heat the water. The tube emits ultrasonic waves of 2450 megacycles, assigned Federal Communications Commission. Water flowing through the system absorbs the energy of the waves and offers a resistance, which heats the water at a rapid rate.

U.S. Pat. No. 3,778,678

Inventor: Raymond E. Long

Issued: Dec. 11, 1973

The disclosure relates to an apparatus for producing super heated fluids by converting electromagnetic energy into thermal energy within the fluid. A coil of low dielectric tubing is placed in a microwave resonant chamber and extends from a fluid inlet to a vapor outlet. The fluid to be super heated passes through the coil and is vaporized directly by microwave energy. The invention is particularly applicable to a vapor powered vehicle that produces no environmental pollution.

U.S. Pat. No. 3,816,689

Inventor: Raymond E. Long

Issued: Jun. 11, 1974

The disclosure relates to an apparatus for producing vapors and super heated fluids by converting electromagnetic energy into thermal energy through irradiation of an intermediate matrix. A coil of tubing having a high thermal conductivity is embedded within this absorptive matrix and the matrix is heated by microwave energy. The fluid to be vaporized or super heated passes through the coil and is vaporized by thermal energy. It is also possible to select matrix and coil materials that will vaporize the fluid through both thermal and microwave irradiation. The invention is particularly applicable to a vapor powered vehicle that produces no environmental pollution.

U.S. Pat. No. 3,891,817

Inventor: Harold Brown

Issued: Jun. 24, 1975

A hydronic heating system includes a heat exchanger, a container, and a microwave heating means associated with the container for heating water therein. The container and heat exchanges are connected by a closed circulation loop which includes a storage tank between the container and heat exchanger and a bypass means to allow flow of water from the heat exchanger to flow directly to the storage tank without passing through the container. A valve is provided in the circulation loop downstream of the by-pass means. A temperature sensor in the storage tank controls operation of a switch in circuit with the valve and microwave heating means. When the temperature of the water in the storage tank is below a predetermined temperature, the switch is closed to simultaneously activate the micro-wave heating means and to open the valve to allow water to flow from the heat exchanger into the container. When the water temperature in the storage tank is above the predetermined temperature, the switch is opened to simultaneously de-activate the microwave heating means and to close the valve to divert water from the heat exchanger through the bypass means into the storage tank. The by-pass means is provided with a check valve and a pump circulates the water through the closed circulation loop.

U.S. Pat. No. 3,920,945

Inventor: Warren B. Smith

Issued: Nov. 18, 1975

A fluid heater is provided for heating dielectric fluids such as water, solutions and gaseous substances utilizing microwave energy. The apparatus consists of a vessel or tank having therein a microwave resonant chamber and a source of microwave energy. The vessel is provided with an inlet for admitting fluid, an outlet for heated fluid and temperature and pressure controls responsive to conditions within the vessel for heating the fluids to a predetermined desired degree. The microwave energy is directed by a wave guide within the vessel for obtaining maximum thermal efficiency. The heater finds utility in the heating of buildings, vehicles and other installations requiring use of a heated fluid and the heater produces no atmospheric or other pollutants in use.

U.S. Pat. No. 4,114,011

Inventor: Elmer L. Stubbs.

Issued: Sep. 12, 1978

Microwave heating method and apparatus for heating a room and like spaces wherein microwave energy is used to heat a fluid medium passed through a microwave energy absorptive chamber with energy reflective walls into which the energy is radiated and contained, and the fluid medium so heated is passed from the absorptive chamber and used to transfer the heat to a room or like space. In one form of the invention disclosed a microwave energy absorbent liquid passed through the absorptive chamber directly receives and converts the microwave energy to heat in the liquid. In another form a microwave energy absorbent body has pipe sections for conducting a liquid through the body and the body heated by the microwave energy transfers heat to a liquid flowing in the pipe sections. In yet another form a plurality of microwave energy absorbent bodies are heated by microwave energy and a liquid is passed over the heated bodies to receive heat therefrom. In a further form of the invention disclosed a plurality of microwave energy absorbent bodies are heated by the microwave energy and a flow of air is passed over the heated bodies to receive heat therefrom. An arrangement of the microwave energy absorbent substance in a parabolic configuration with the output of the source of microwave energy at approximately the focal point is highly effective for increasing energy absorption by the absorbent substance.

U.S. Pat. No. 4,358,652

Inventor: Darrell R. Kaarup.

Issued: Nov. 9, 1982

A fluid heater apparatus for providing heated fluid on demand, the apparatus including at least two microwave heating units with coiled tubing disposed in the microwave field and connected to a valving and electrical system wherein heated fluid is supplied alternately from the units thus permitting one unit to heat fluid therein and the other to supply heated fluid therefrom and thereby supply a continuous flow of heated fluid and yet providing no storage facilities for holding heated fluid other than the coiled tubing in the microwave field.

U.S. Pat. No. 6,064,047

Inventor: Daniel R. Izzo

Issued: May 16, 2000

A Microwave Hot Water Boiler Heating System includes a water tank with a water boiler circulator and a water refill valve and a water drain valve and a cooled water pipe that comes from the steam cooling chamber. A vacuum pump is employed to depressurize the boiler tank and vacuum pump the steam that is produced by the heated water that was heated by the microwaves coming directly from the magnetron maser. Vacuum pumping the steam from the microwave boiler heating area prevents the pressurization of steam that would damage the machine's magnetron maser. The vacuum pump also will, by its force, draw in air from the boiler tank's air inlet/overflow valve and by its force contain and compress the steam inside of the machine's steam chamber. Both, the water boiler tank and the steam chamber shall have a closed loop of coiled piping that will transfer heat to a room radiator heat exchanger. The closed loop of piping shall be filled with circulating water that is circulated by a circulator pump. Inside of the steam chamber shall be pressure reducing valves that allow for the release of either cooled water or steam. The machine's microwave emitting magnetron maser will operate upon command by a room air temperature sensor/thermostat.

International Patent Number DE3139268

Inventor: Gerhard Reinke

Issued: Apr. 21, 1983

The device comprises a high-frequency generator, for example a magnetron, which is associated with a resonance chamber which is surrounded by a jacket of a mixture of organic and inorganic substances. In the jacket, a pipe is arranged as a heating coil for a liquid flowing through. The jacket mixture consisting of natural rubber, carbon black and a small proportion of ground rock is intermittently heated by the microwaves and releases the heat to the liquid in the pipe. The jacket mixture functioning as a transfer medium responds in a most surprising way to the microwaves, can be heated rapidly, has a conspicuously long afterheating time and, as a heat exchanger, possesses particularly advantageous properties. The use as a heating oven in heating installations may be mentioned as a preferred field of application.

International Patent Number EP0351300

Inventor: Jean-Claude Deronzier

Issued: Jan. 17, 1990

The device comprises a high-frequency generator, for example a magnetron, which is associated with a resonance chamber which is surrounded by ajacket of a mixture of organic and inorganic substances. In the jacket, a pipe is arranged as a heating coil for a liquid flowing through. The jacket mixture consisting of natural rubber, carbon black and a small proportion of ground rock is intermittently heated by the microwaves and releases the heat to the liquid in the pipe. The jacket mixture functioning as a transfer medium responds in a most surprising way to the microwaves, can be heated rapidly, has a conspicuously long after heating time and, as a heat exchanger, possesses particularly advantageous properties. The use as a heating oven in heating installations may be mentioned as a preferred field of application.

International Patent Number WO95/08908

Inventor: William Riley

Issued: Feb. 7, 1995

An apparatus and method for heating water using a microwave powered boiler. The apparatus consists of a three cabinet arrangement which permits the dry incorporation of wave guides and the tunneling of microwave energy completely around and into a seamless water chamber. The apparatus can be adapted to provide a hydronic heating system, a forced hot air heating system, a tankless domestic hot water supply and a hot water heater.

International Patent Number WO2004/054705

Inventor: Mangus Fagrell

Issued: Jul. 1, 2004

Microwave heating system comprising a plurality of microwave applicators for heating loads arranged in said applicators, a control means, one microwave generator to generate microwave energy having a controllable frequency and power level, and a microwave switch arranged to connect said microwave generator to each of said applicators. Each microwave applicator is dedicated a heating time slot in a time frame, and that said time frame comprises time slots for applicators to be heated. During microwave heating, microwave energy is applied to the microwave applicators in its respective time slot, in consecutive time frames.

Most central heating systems today are either forced warm air or hydronic (hot water). The systems consist of a heating unit, distribution system, and controls, such as thermostats, that regulate the system. Forced warm air is the most common central heating system in North American homes. The system distributes heat from a central furnace through air ducts and registers as well as filters and humidifies air, to provide central air conditioning and circulate air for ventilation. Despite its many advantages, forced warm air systems contain a number of disadvantages.

Air originating from the heating registers can feel cool at times despite the air temperature being warmer than room temperature. Short bursts of very hot air, which are common in oversized units, are also unfavorable. Air ducts transmit furnace noise and circulate dust and odors. Additionally, ducts can be notoriously leaky. A typical home's heating cost is raised by 20% to 30% by loss from leaky ducts. Therefore, a need exists for providing an air heating system which overcomes these disadvantages.

Instead of circulating warm air throughout a home, the hydronic system pumps hot water from a boiler through pipes and radiators and returns it to be reheated and recirculated. The hydronic system is able to regulate the temperature in each room and use the same boiler for domestic hot water. However, the installed cost of hydronic systems is higher than that of forced-air systems, and the system can be slow to warm up. Therefore, there exists a need for a less expensive microwave heating system providing quick heating of the boiler.

While these heating systems may be suitable for the purposes for which they were designed, they would not be as suitable for the purposes of the present invention, as hereinafter described.

SUMMARY OF THE PRESENT INVENTION

The present invention relates generally to heating systems and, more specifically, to microwave hydronic heating systems. The present invention provides a hydronic heating system with improved efficiency and selectability. The hydronic system pumps hot water from a boiler through pipes and radiators and returns it to be reheated and recirculated. The microwave heating system of the present invention consists of a holding tank surrounding the central core containing water that is held proximate to microwave emitters for heating the water. The microwave emitters irradiate the contained water and central core uniformly causing the water causes the water and the core's temperature to rise. The temperature of the water is maintained by the retention of heat energy within the central core gathered from the emitted microwaves.

A primary object of the hydronic heating system of the present invention is to overcome the shortcomings of the prior art systems.

Another object of the present invention is to regulate room temperatures and provides domestic hot water using a single boiler. The microwave heating method of the present invention provides quick heating of the boiler. Additionally, the microwave heating system may economically convert existing hydronic system or be installed as a standalone system.

Yet another object of the present invention is to provide to provide a hydronic heating system powered by microwaves.

Still yet another object of the present invention is to provide a microwave hydronic heating system including of a holding tank to serve as a tank base to hold, retain, store and distribute the heated water.

Another object of the present invention is to provide a microwave hydronic heating system including of an emitter assembly for the deliverance of microwaves throughout the water held in a holding tank.

Yet another object of the present invention is to provide a microwave hydronic heating system including of a cover assembly for the protection and insulation of the emitter assembly.

Still yet another object of the present invention is to provide a control panel located on the exterior of the cover assembly for the control and setting of temperatures by the user.

Another object of the present invention is to provide a microwave hydronic heating system that improves safety and is more efficient than currently used heating systems Yet another object of the present invention is to provide a microwave hydronic heating system that may be retrofitted into existing systems, or be installed as a new heating system A still further object of the present invention is to provide a microwave hydronic heating system that is economical in cost to manufacture.

Additional objects of the present invention will appear as the description proceeds.

The present invention overcomes the shortcomings of the prior art by providing a microwave hydronic heating system that overcomes disadvantages of current dry air and hydronic heating systems.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which:

FIG. 12 is a chart of the advantages associated with the various heating systems shown in FIG. 10.

DESCRIPTION OF THE REFERENCED NUMERALS

Figure 1:
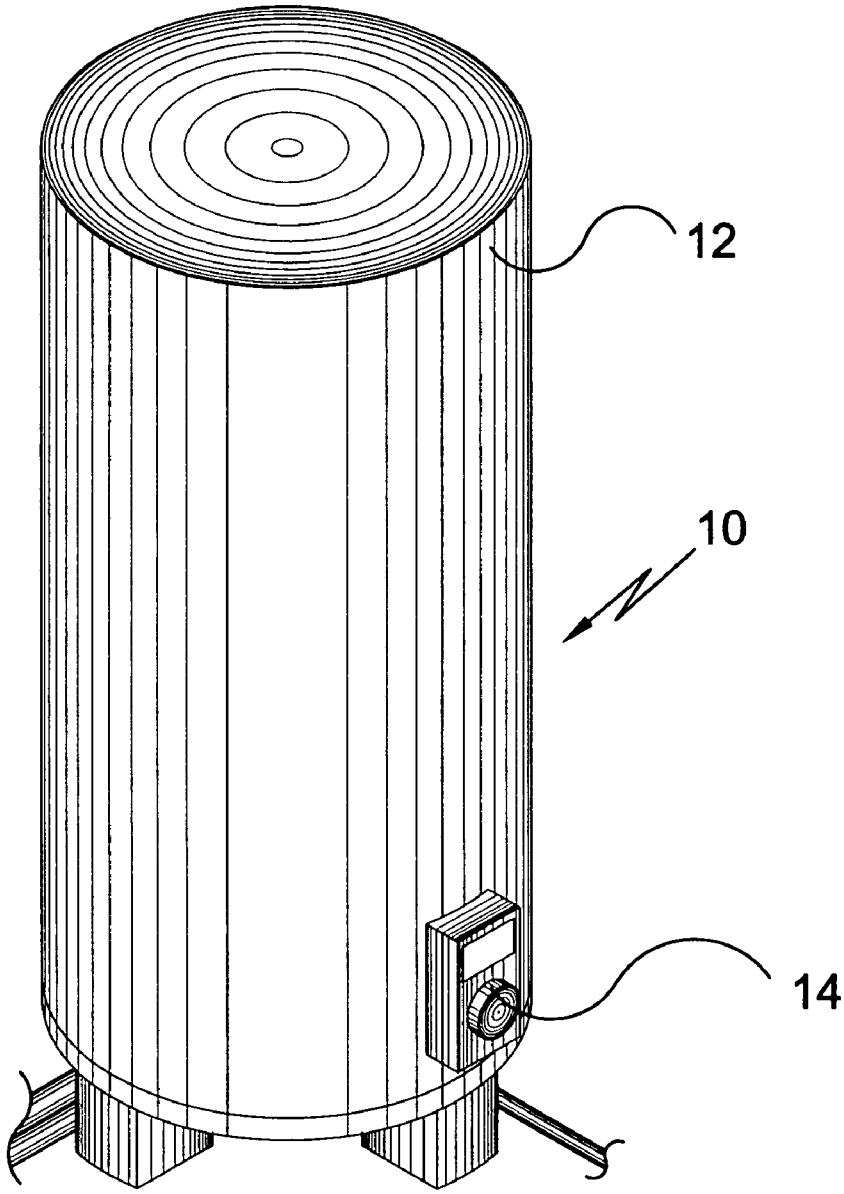
FIG. 1 is an illustrative view of the microwave heating system of the present invention.

Turning now descriptively to the drawings, in which similar reference characters denote similar elements throughout the several views, the Figures illustrate the microwave heating system of the present invention. With regard to the reference numerals used, the following numbering is used throughout the various drawing Figures.

10 Microwave Hot Water System of the present invention
12 Cover Assembly
14 Control Panel
16 Holding Tank
18 Armature
20 Motor
22 Microwave Emitter
24 Bearing Ring
26 Support Ring
28 Connection Base
30 Plumbing
32 Gearbox
34 Contained Water
36 Rotate Collar
38 Emitter Support
40 Central Core
42 Microwave
44 Rotational arrows
100 Microwave heating system of the present invention
200 Home and commercial heating systems
210 Natural gas heating system
220 Oil burning heating system
230 Kerosene burning heating system
240 Coal burning heating system
250 Wood burning heating system

DETAILED DESCRIPTION OF THE PREFERRED EMBODIMENT

The following discussion describes in detail one embodiment of the invention and several variations of that embodiment. This discussion should not be construed, however, as limiting the invention to those particular embodiments, practitioners skilled in the art will recognize numerous other embodiments as well. For definition of the complete scope of the invention, the reader is directed to appended claims.

Turning now descriptively to the drawings, in which similar reference characters denote similar elements throughout several views, FIGS. 1 through 12 illustrate the microwave hot water system which is indicated generally by the numeral 10.

In modern households it is desirable to have a heating system able to heat the house and water simultaneously. While systems exist for heating there is a need for a system which provides heating and overcomes the deficiencies and disadvantages of the current systems.

Figure 2:
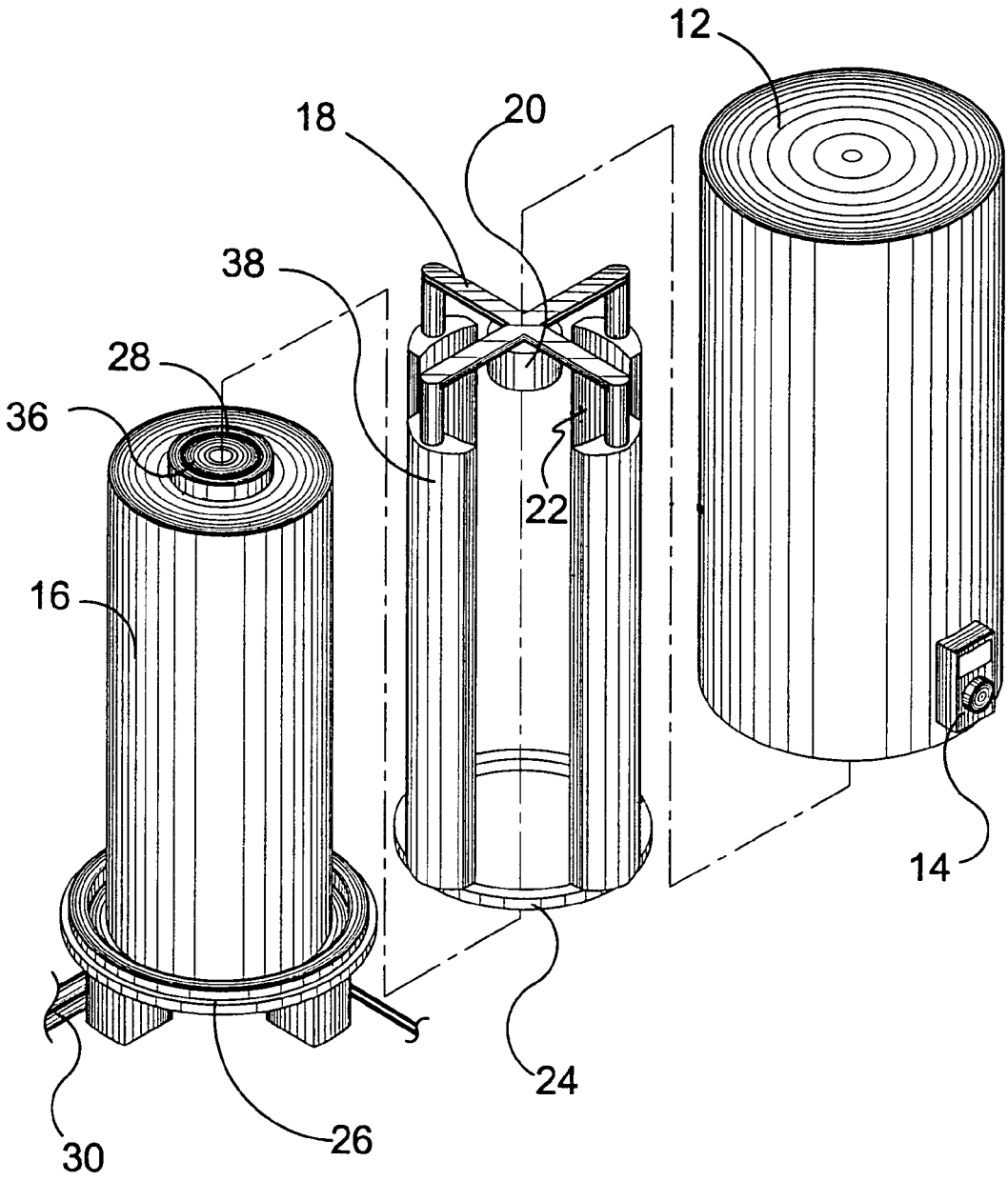
FIG. 2 is an exploded view of the microwave heating system of the present invention.

FIG. 1 is an illustrative view of the present invention. The microwave hot water system 10 of the present invention heats a water holding tank 16 using a system of rotating microwave emitters 22, as shown in FIG. 2. The microwave hot water system 10 of the present invention is preferably a cylinder in shape. However, the system 10 of the present invention may be formed in any shape that is suited to function as a boiler system. This shape provides seamless integration into current setups for it could fit in the exact space of a previous boiler. To protect against damage and provide insulation from external factors, such as outside temperatures, the microwave hot water system 10 is protected and covered by a cover assembly 12. The control panel 14 is positioned on the exterior surface of the cover assembly 12 to provide user input to control the hot water system 10.

FIG. 2 is an exploded view of the microwave hot water system 10 of the present invention. The microwave hot water system 10 of the present invention heats a water holding tank 16 using a system of rotating microwave emitters 22. The microwave hot water system 10 includes three layers concentrically positioned within one another. The innermost layer includes the holding tank 16 positioned around a core. Plumbing 30 is connected to the microwave hot water system 10 for transporting water into and out of the system. The water is contained within holding tank 16 which is supported by support ring 26. The connection base 28, which is positioned on a topside of holding tank 16, connects a motor 20 to the holding tank 16. Rotate collars 36, positioned atop holding tank 16, allow the motor 12 to operate without tangling wires by providing power via brushes instead of wires.

The intermediate layer is the rotating heating device. In a preferred embodiment four microwave emitters 22 are connected to an armature 18 in a criss-cross pattern. The motor 20 is connected on the underside of armature 18 and, when placed atop connection base 28, connects the armature 18 to the holding tank 16. A microwave emitter 22 is connected by emitter supports 30 at each respective distal end of the criss-cross shaped armature 18. A bearing ring 24 is located beneath the microwave emitters 22 for support thus connecting the emitters 22 between the armature 18 and the bearing ring 24. The motor 20 causes the microwave emitters 22 to rotate about the outer surface of the holding tank when connected to connection base 28. When connected the microwave emitters 22 rotate about the holding tank 16, uniformly heating the water.

The outermost layer, made up of the cover assembly 12 and control panel 14, is positioned over the intermediate layer forming a seal with support ring 26. Cover assembly 12 provides protection and insulation from external factors, such as external temperatures. The control panel 14 provides a user input device, such as a knob, indicating the desired water temperature of the user. Upon adjustment of the knob of the control panel 14, the microwave emitters 22 are caused to at least one of increase the frequency which microwaves are emitted, decrease the frequency which microwaves are emitted, increase the intensity of the microwave and decrease the intensity of the microwave thereby adjusting the temperature of the water in the holding tank 16.

Figure 3:
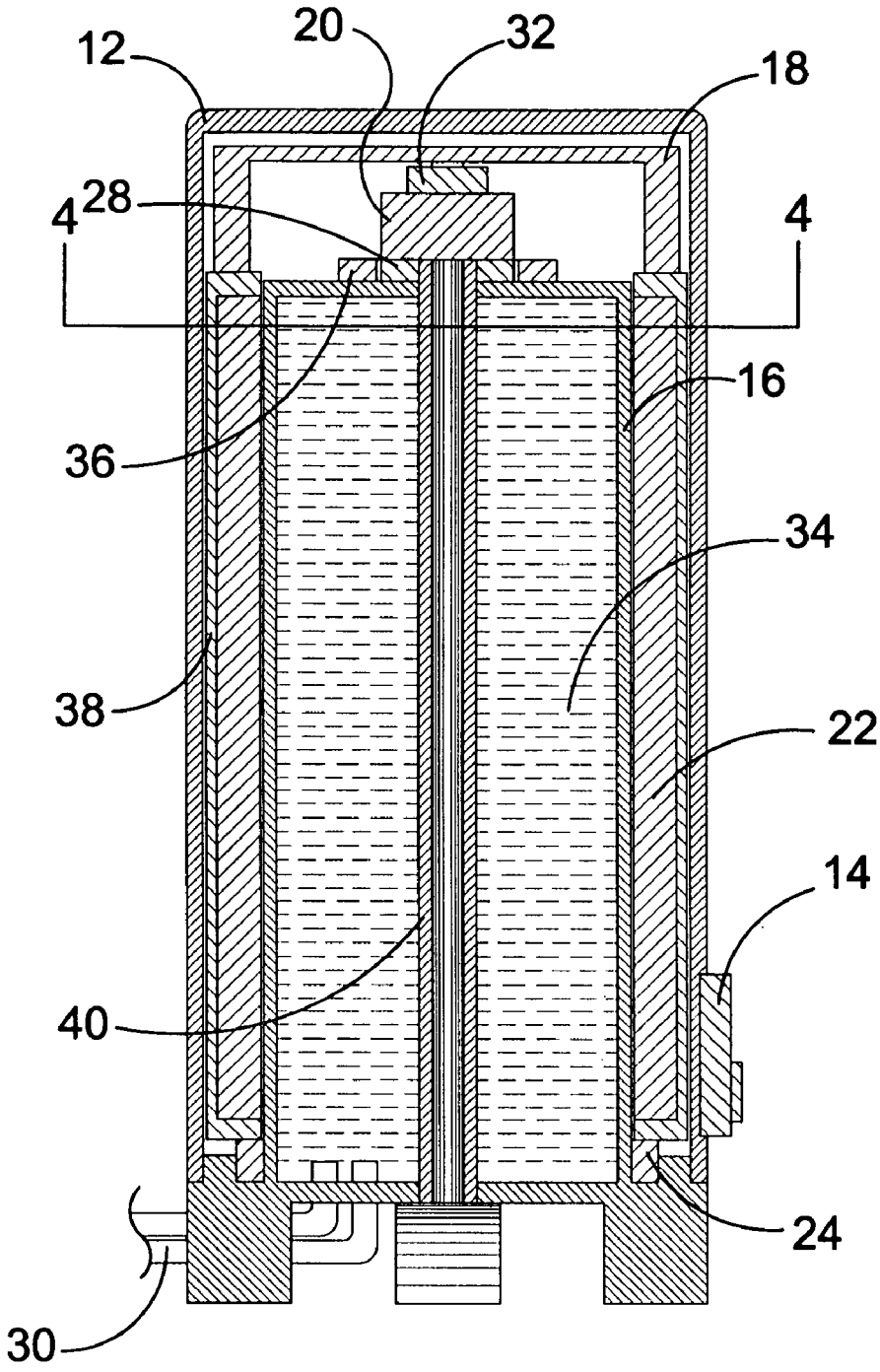
FIG. 3 is a cross sectional view of the microwave heating system of the present invention taken along the line labeled 4—4 in FIG. 3.

FIG. 3 is a cross sectional view of the microwave heating system of the present invention. The microwave hot water system 10 of the present invention heats a water holding tank 16 using a system of rotating microwave emitters 22. The microwave hot water system 10 includes three layers concentrically positioned within one another. The innermost layer is concentrated with holding tank 16 positioned around the core 40. The core 40 is heat retentive and helps to heat the water within holding tank 16 as well allows the water to retain the desired temperature. Plumbing 30 is connected to the microwave hot water system 10 for transporting water into and out of the system. The water is contained within holding tank 16 which is supported by support ring 26. The connection base 28, which is positioned on a topside of holding tank 16, connects a motor 20 to the holding tank 16. Rotate collars 36, positioned atop holding tank 16, allow the motor 12 to operate without tangling wires by providing power via brushes instead of wires.

The intermediate layer is the rotating heating device. In a preferred embodiment four microwave emitters 22 are connected to an armature 18 in a criss-cross pattern. The motor 20 is connected on the underside of armature 18 and, when placed atop connection base 28, connects the armature 18 to the holding tank 16. A microwave emitter 22 is connected by emitter supports 30 at each respective distal end of the criss-cross shaped armature 18. A bearing ring 24 is located beneath the microwave emitters 22 for support thus connecting the emitters 22 between the armature 18 and the bearing ring 24. The motor 20 causes the microwave emitters 22 to rotate about the outer surface of the holding tank when connected to connection base 28. When connected the microwave emitters 22 rotate about the holding tank 16, uniformly heating the water.

The outermost layer, made up of the cover assembly 12 and control panel 14, is positioned over the intermediate layer forming a seal with support ring 26. Cover assembly 12 provides protection and insulation from external factors, such as external temperatures. The control panel 14 provides a user input device, such as a knob, indicating the desired water temperature of the user.

Figure 4:
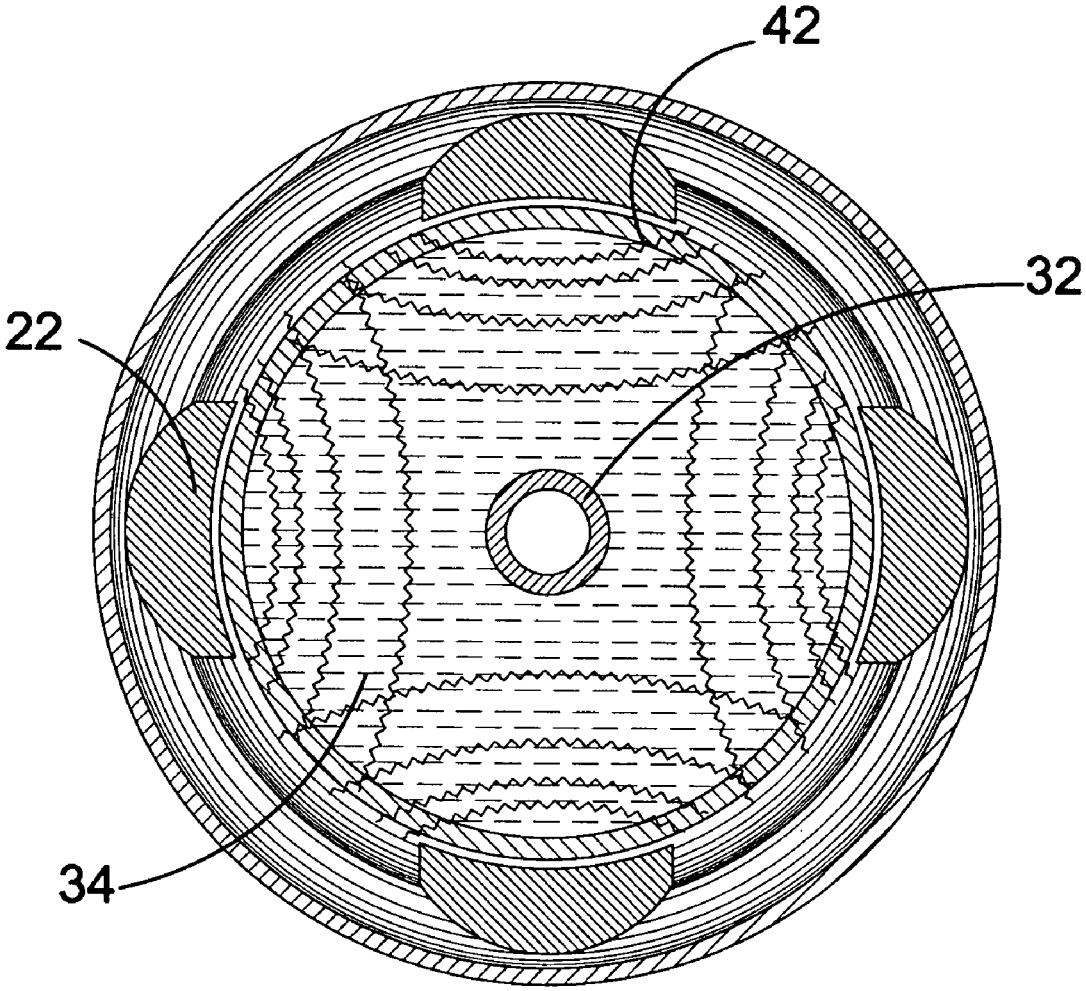
FIG. 4 is an aerial cross sectional view of the microwave heating system of the present invention.

FIG. 4 is an aerial cross sectional view of the microwave heating system of the present invention. The microwave hot water system 10 of the present invention heats a water holding tank 16 using a system of rotating microwave emitters 22. The central core 40 is located in the center of hollow cone within the holding tank 16. As the microwave emitters 22 are rotated around the holding tank 16 microwaves 42 are emitted from microwave emitters 22. The microwaves 42 heat central core 40 and contained water 34 thereby raising the temperature of each thereof. The central core 40 is heat retentive, helping to warm the water during and after the microwave heating process. In the preferred embodiment four microwave emitters are displayed. However, in alternate embodiments and number of emitters may be used to heat the water and core.

Figure 5:
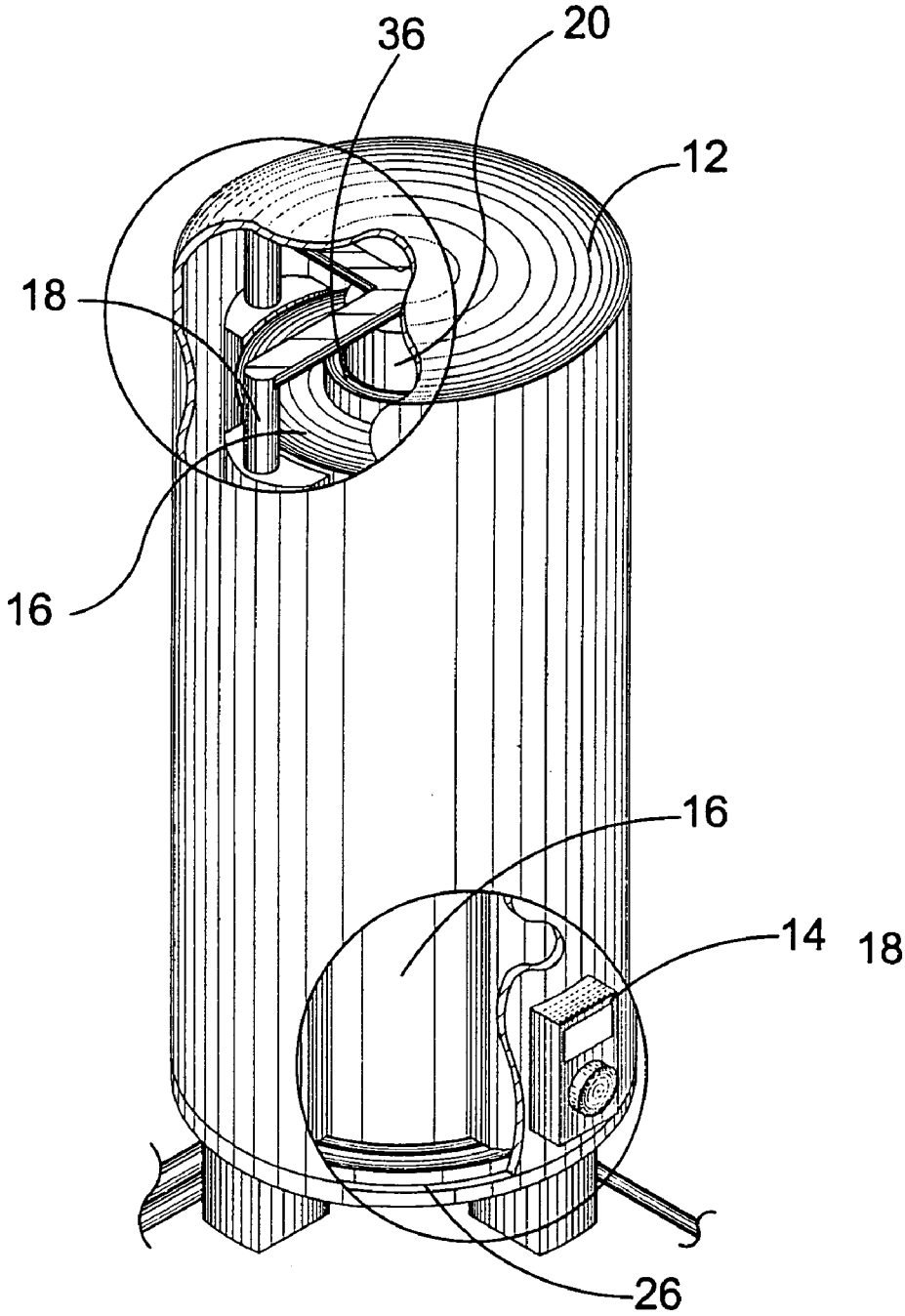
FIG. 5 is a sectional view of the present microwave heating system of the invention.

FIG. 5 is a sectional view of the present microwave heating system of the invention. The microwave hot water system 10 of the present invention heats a water holding tank 16 using a system of rotating microwave emitters 22. In a first layer, water is contained within holding tank 16. The water is heated by the intermediate layer, containing microwave emitters 22 rotated by motor 20. The upper support of microwave emitters 22 consists of an armature 18 connected atop motor 20. Rotate collars 36, positioned atop holding tank 16, allow the motor 12 to operate without tangling wires by providing power via brushes instead of wires. The third outermost layer consists of cover assembly 12 and control panel 14. Cover assembly 12 provides protection and insulation from external factors. The control panel 14 provides the user with the ability to change the settings of the microwave hot water system 10.

Figure 6:
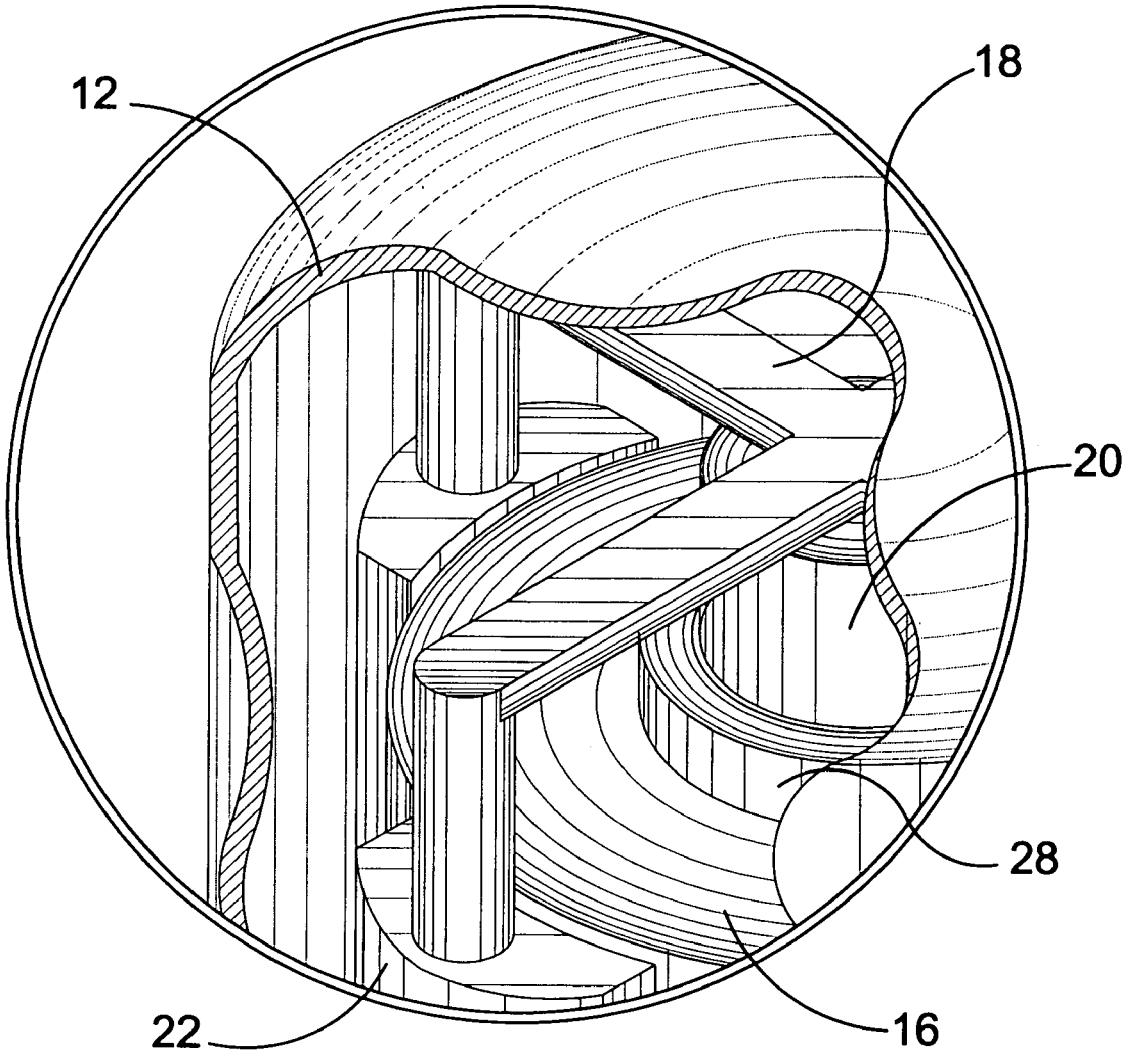
FIG. 6 is a detailed cut away view of the microwave heating system of the present invention.

FIG. 6 is a detailed cut away view of the microwave heating system of the present invention. The microwave hot water system 10 of the present invention heats a water holding tank 16 using a system of rotating microwave emitters 22. In the innermost layer water is contained within holding tank 16. The water in holding tank 16 is heated by a intermediate layer using microwaves from microwave emitters 22 contained therein. Microwave emitters 22 are supported by an armature 18. Upon the rotation of motor 20, the armature 18 connected atop motor 20 rotates supported microwave emitters 22 about holding tank 16. The outermost layer contains a cover assembly 12 to provide protection and insulation from external factors.

Figure 7:
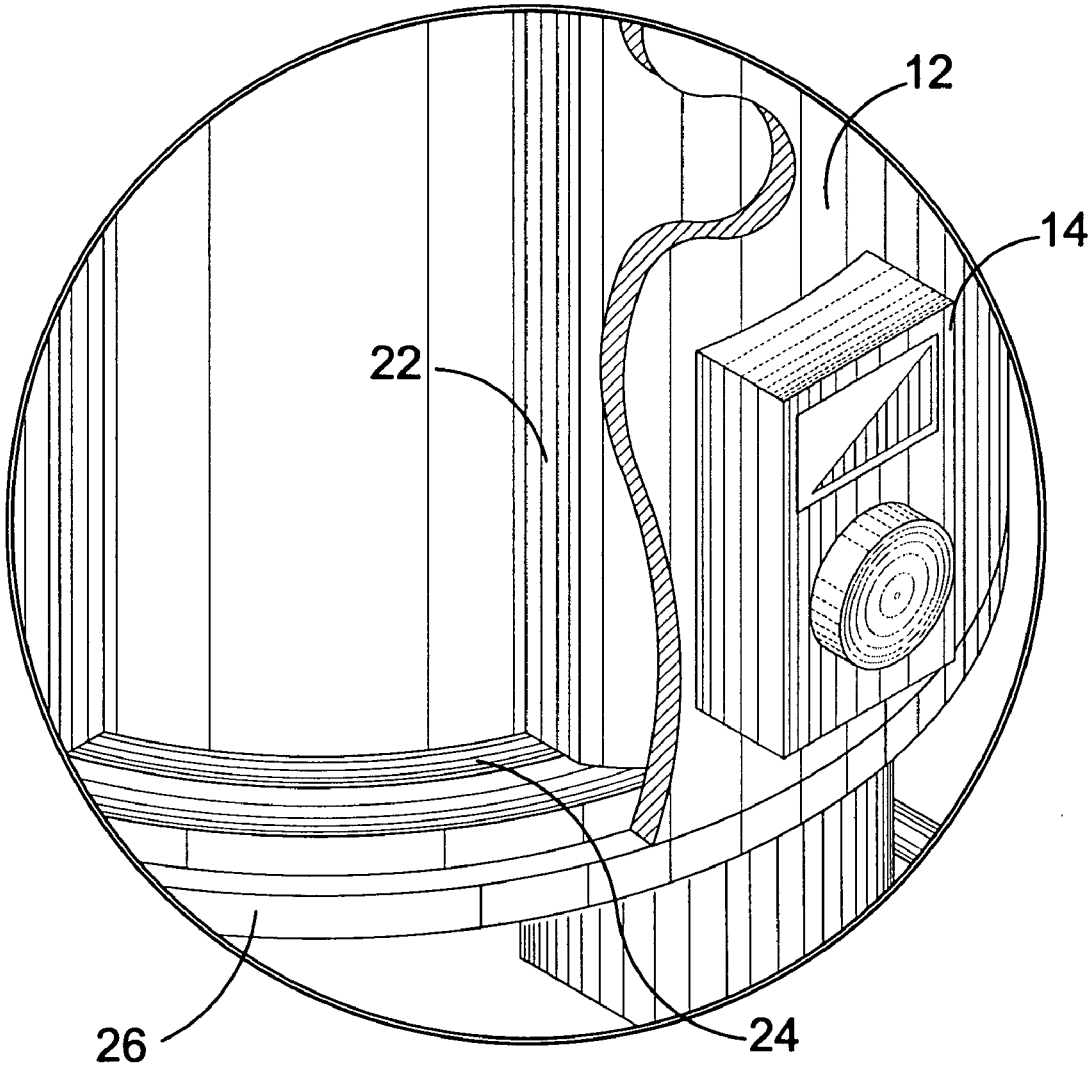
FIG. 7 is a detailed cut away view of the microwave heating system of the present invention.

FIG. 7 is a detailed cut away view of the microwave heating system of the present invention. The microwave hot water system 10 of the present invention heats a water holding tank 16 using a system of rotating microwave emitters 22. Rotating microwave emitters 22 are secured with a lower circular support setup of bearing ring 24. To protect and insulate against external factors cover assembly 12 surrounds the rotating microwave emitters 22. The cover assembly 12 is positioned atop a support ring 26 fixed to the base. The control panel 14, positioned on the exterior surface of cover assembly 12, provides the user with the ability to change the settings of the microwave hot water system 10.

Figure 8:
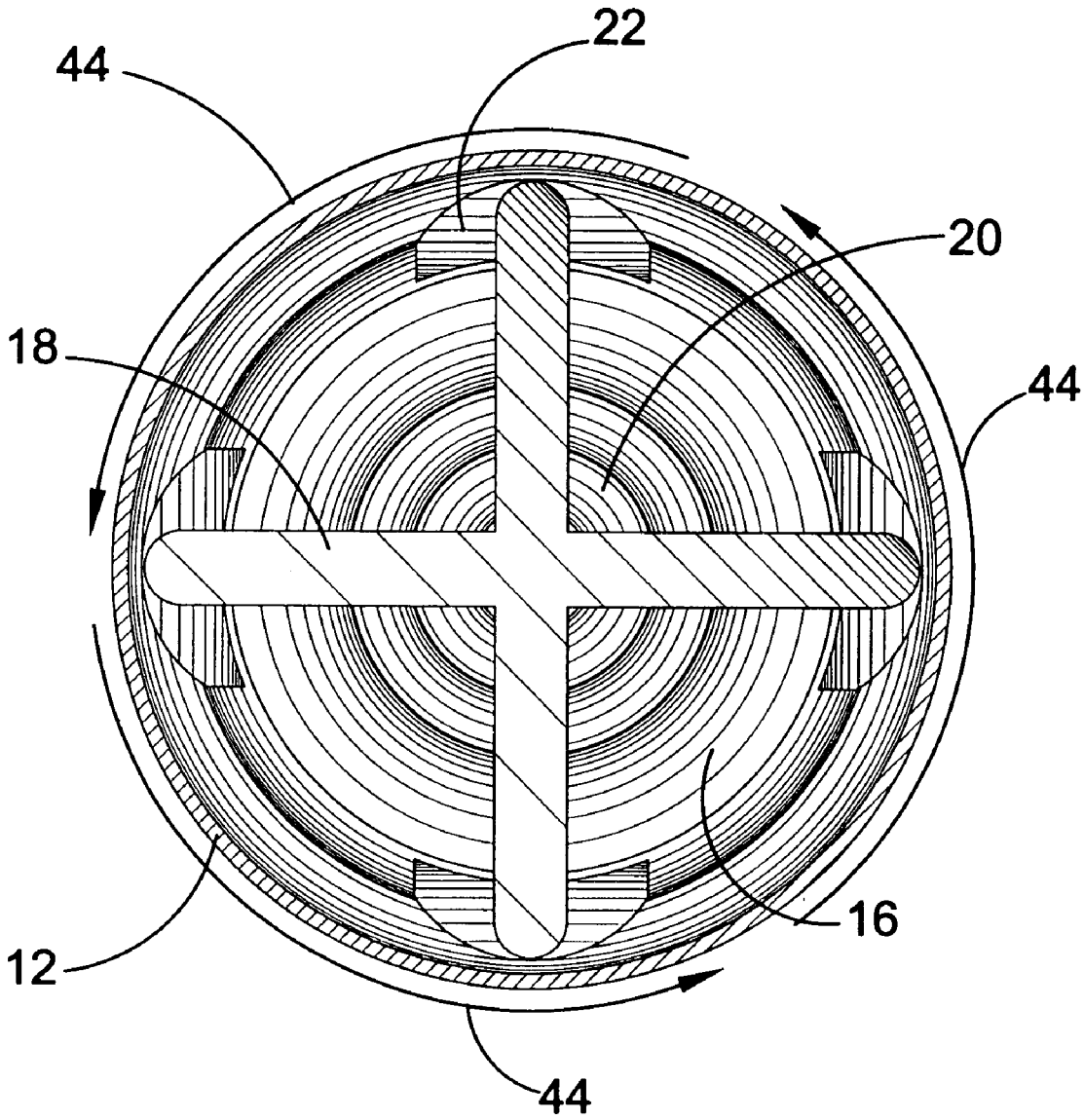
FIG. 8 is an aerial sectional view of the microwave heating system of the present invention.

FIG. 8 is an aerial sectional view of the microwave heating system of the present invention. The microwave hot water system 10 of the present invention heats a water holding tank 16 using a system of rotating microwave emitters 22. Water is contained within holding tank 16. The water within holding tank 16 is heated by microwaves emitted from microwave emitters 22. The motor 20 rotates the armature 18 which in turn rotates microwave emitters 22 in the direction of rotational motion 44. The microwave emitters 22 are secured with an upper support armature 18. The rotation of microwave emitters 22 provides a uniform heating method for all the water within holding tank 16. Cover assembly 12 provides protection and insulation from external factors.

Figure 9:
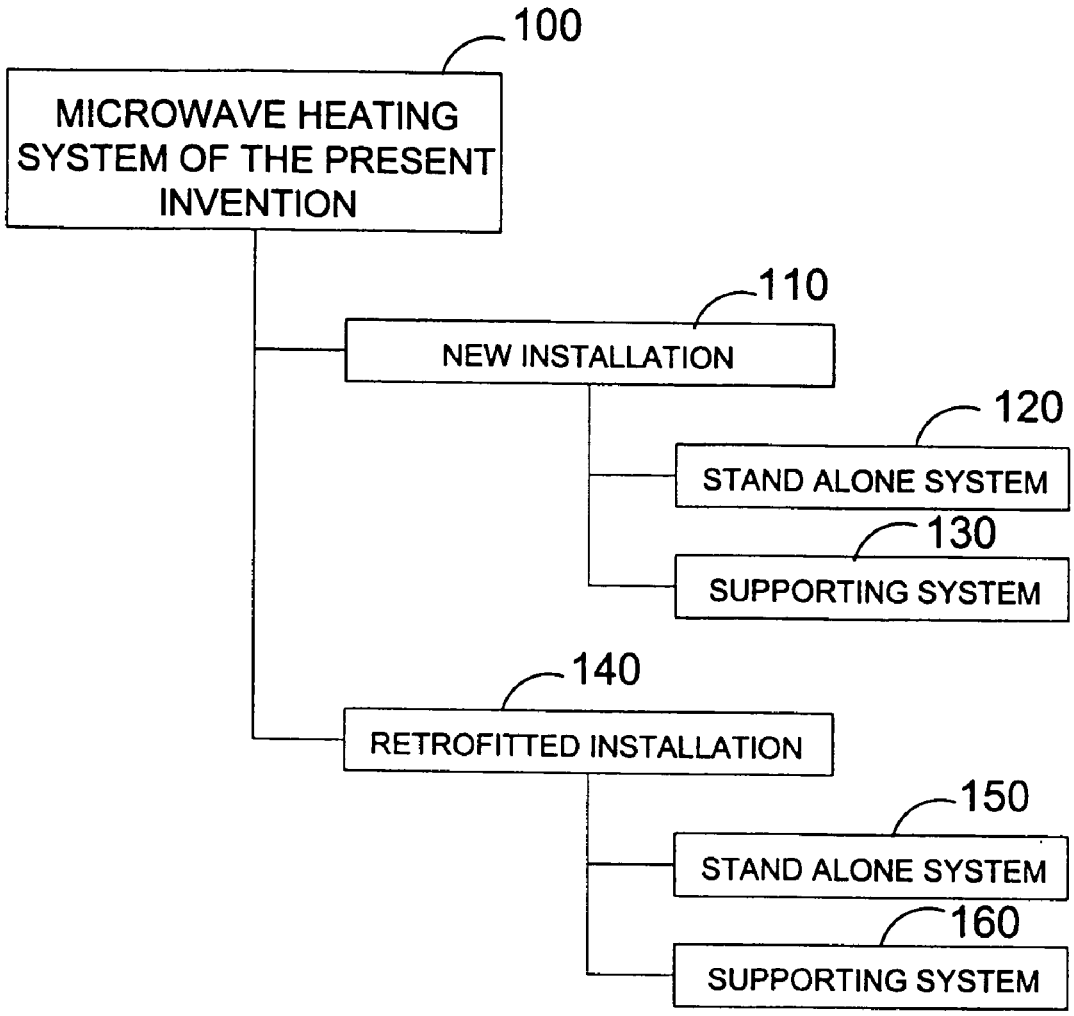
FIG. 9 is a block diagram of the microwave heating system of the present invention.

FIG. 9 is a block diagram of the microwave heating system of the present invention. The microwave hot water system 10 of the present invention heats a water holding tank 16 using a system of rotating microwave emitters 22. The microwave heating system of the present invention, 100, can be installed as a new installation, 110, as a retrofitted installation into a pre-existing setup, 140. The new installation, 110, can be setup as a stand alone system where the microwave heating system is the primary heating system, 120, or as a supporting system alongside another installed heating system, 130. The retrofitted installation, 140, can be setup as a stand alone system where the microwave heating system is reconfigured as the primary heating system, 150, or as a supporting heating system to the pre-installed heating system, 160. The versatility of installation allows users to use the present invention in conjunction with a system more familiar or even within a pre-existing setup for cost efficiency.

Figure 10:
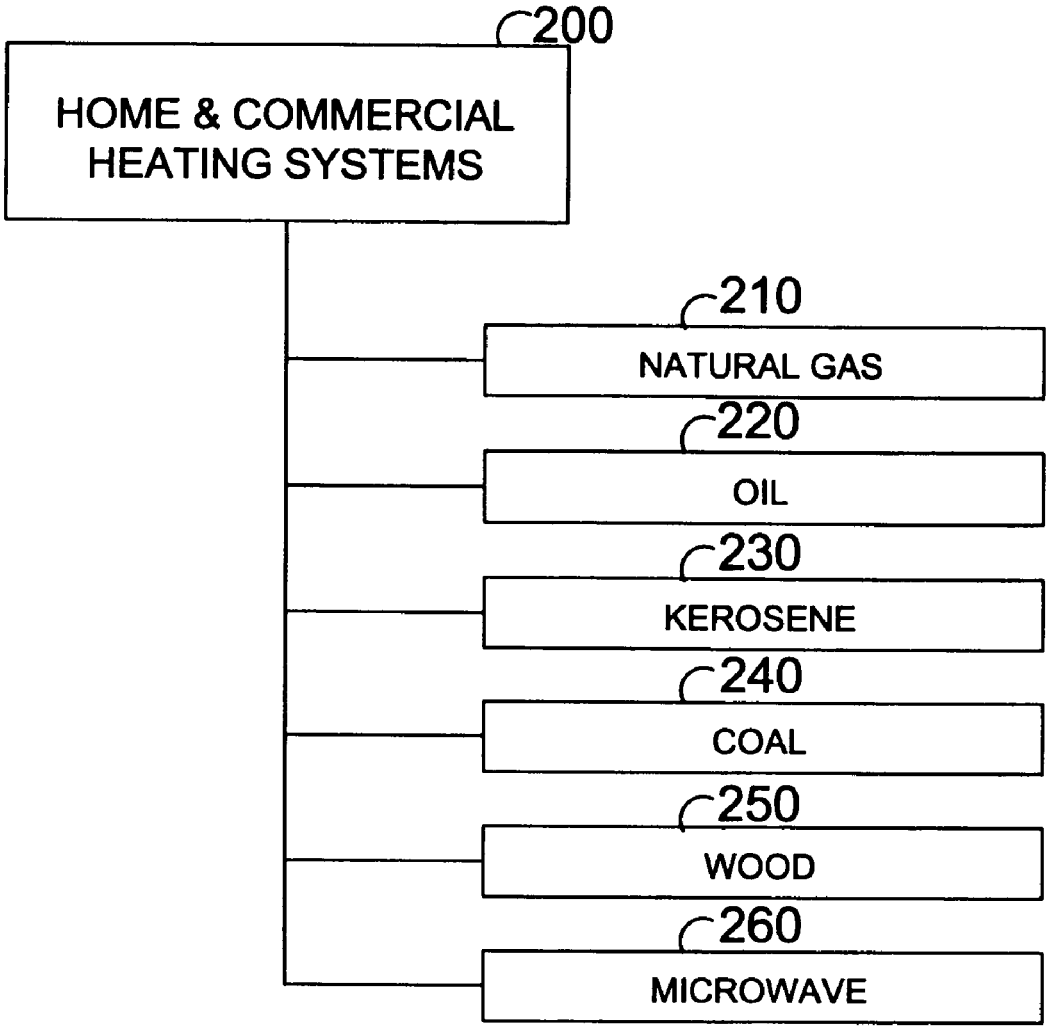
FIG. 10 is a block diagram of a plurality of heating systems, including the microwave heating system of the present invention.

FIG. 10 is a block diagram of various heating systems. Many systems exist for home and commercial heating systems, 200. Gas systems currently available include natural gas 210, oil 220 and kerosene 230. Coal 240 and wood burning 250 systems make up the other two kind of burning systems available before the microwave hot water system of the present invention 260. The microwave hot water system of the present invention 260 is now added as a more efficient and optimal system available as a home or commercial heating system as will be discussed hereafter with specific reference to FIG. 11.

Figure 11:
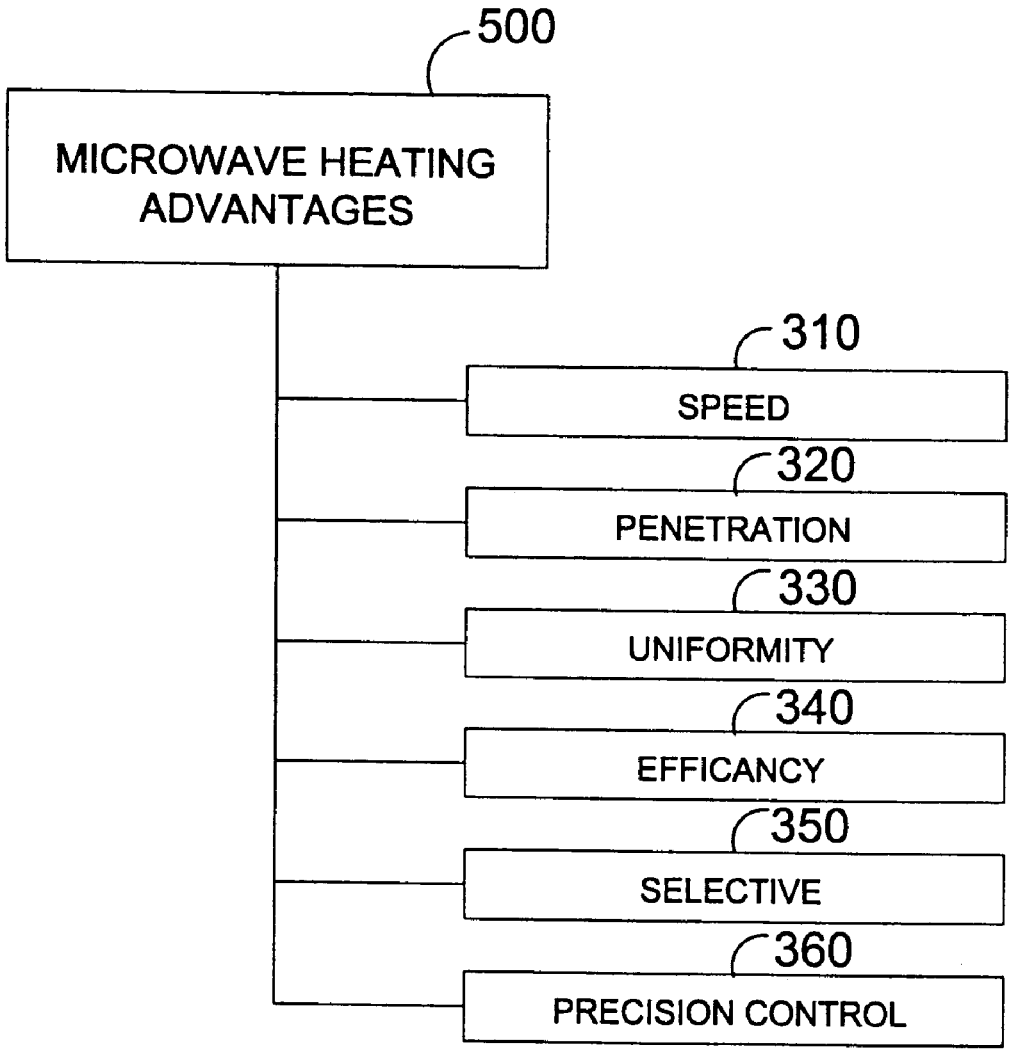
FIG. 11 is a block diagram of the microwave heating system of the present invention.

FIG. 11 is a block diagram of the microwave heating system of the present invention. The microwave heating system of the present invention has many advantages, 300, over the systems currently available. The microwave heating technique used in the present invention increases the speed, 310, for heating water. Unlike conventional heating methods the microwave heating method uses microwaves which penetrate the water 320 to heat a greater amount of the water contained therein as opposed to merely heating the water adjacent to the heating apparatus. This penetration allows for a uniform warming of the contained water, 330, and not merely warming a specific location and waiting for the water temperatures to reach equilibrium. This system is much more efficient then, for example, the forced air system for it avoids leaks and heat loss. The present system can be used selectively 350 as a water boiler and/or air heating unit and can be used as a standalone or supporting system. Microwave heating provides greater precision, 360, in relation to the actual temperature and the desired temperature of the water.

FIG. 12 is a chart detailing the advantages and disadvantages of various heating systems. Column 1 contains the current available heating systems as well as the microwave heating system of the present invention. The microwave system as shown in row 1 has many advantages such as precision control, efficiency, uniformity and absence of fire for enhanced safety. Yet the microwave system of row 1 includes only a single disadvantage, power requirements. This is unlike the prior art heating systems described in rows 2–6 which each have a plurality of disadvantages. Oil burning systems, as shown in row 2, and kerosene systems, as shown in row 3, have the disadvantage of needing periodic fuel replenishing though kerosene systems provide more fire safety then oil systems. Coal, as shown in row 4, and wood, as shown in row 5, systems do not require power but they provide un-proportioned heating and leave byproduct after use. Although natural gas systems, row 6, provide economic and clean systems they require annual service and present fire hazards. Therefore, it is seen that the microwave heating system of the present invention, as shown in row 1, contains many more advantages and fewer disadvantages than the prior art systems listed in rows 2–6.

It will be understood that each of the elements described above, or two or more together may also find a useful application in other types of devices differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

The invention claimed is:

1. A microwave heating system comprising:

a) a central core;

b) a holding tank positioned around said central core for retaining water therein;

c) a rotating heating device positioned around said holding tank comprising:

i) a motor connected to said holding tank;

ii) an armature connected to said motor;

iii) a plurality of microwave emitters depending from and supported by said armature; and iv) a bearing ring connected to each of said plurality of emitters at an end opposite said armature further supporting said plurality of microwave emitters.

2. The microwave heating system of claim 1, further comprising a cover assembly placed over said rotating heating device.

3. The microwave heating system of claim 2, further comprising a control panel positioned on said cover assembly for controlling said rotating heating device.

4. The microwave heating system of claim 2, wherein said cover assembly insulates and protects said holding tank and said rotating heating device.

5. The microwave heating system of claim 3, wherein said control panel allows a user to selectively control a temperature of said water contained within said holding tank.

6. The microwave heating system of claim 1, wherein said central core is formed from a material able to absorb and retain heat.

7. The microwave heating system of claim 1, further comprising conduits connected to said holding tank for transportation of water in and out of said holding tank.

8. The microwave heating system of claim 1 further comprising an elevated connection base extending from said holding tank connecting said motor to said holding tank.

9. The microwave heating system of claim 1 wherein rotate collars provide power to said motor and said multiple microwave emitters.

10. A method for heating water using a microwave heating device system comprising the steps of:

a. providing water to a holding tank;

b. setting the temperature level of said water in response to user input on a control panel;

c. activating a microwave heating device to emit microwaves;

d. rotating the microwave heating device around the holding tank whereby the microwaves penetrate the holding tank for uniformly holding the water contained within the holding tank; and e. providing the heated water from the holding tank.

11. The method of claim 10, further comprising the step of adjusting the temperature level in response to a second user input.

12. The method of claim 10, wherein said step of rotating the microwave heating further comprises the step of rotating the microwave heating device at a constant speed.

13. The method of claim 10, further comprising the step of maintaining the level of water within the holding tank at a predetermined level.

14. The method of claim 10, wherein said step of adjusting further comprises adjusting the temperature to a desired temperature value.

15. The method of claim 10, further comprising the step of calculating, in response to the user input, the frequency and strength of microwaves to be emitted in said step of emitting.

16. The method of claim 10, further comprising the step of monitoring the temperature of the water contained within the holding tank.

17. The method of claim 15, further comprising the step of adjusting, based on the temperature of the water in the holding tank, the strength and frequency of microwaves emitted in said step of emitting.

18. The method of claim 10, wherein the holding tank is positioned around a core, and further comprising the step of increasing a temperature of the core and retaining the heat therein.

19. The method of claim 18, further comprising the step of maintaining a desired temperature using the heat retained by the core.

20. The method of claim 10, wherein said step of rotating the microwave heating further comprises the step of rotating the microwave heating device at a variable speed.

* * * * *